US006436889B1

(12) United States Patent
Sta et al.

(10) Patent No.: US 6,436,889 B1
(45) Date of Patent: Aug. 20, 2002

(54) DETERGENT COMPOSITIONS

(75) Inventors: Mirjam Sta; Ronaldus Wilhelmus Westerhout, both of Vlaardingen (NL)

(73) Assignee: Unilever Home & Personal Care USA division of Conopco, Inc., Chicago, IL (US)

( * ) Notice: Subject to any disclaimer, the term of this patent is extended or adjusted under 35 U.S.C. 154(b) by 61 days.

(21) Appl. No.: 09/627,089

(22) Filed: Jul. 27, 2000

(30) Foreign Application Priority Data

Jul. 30, 1999 (GB) ..... 9918020

(51) Int. Cl.[7] ..... C11D 17/00; C11D 3/12

(52) U.S. Cl. ..... 510/298; 510/334; 510/446; 510/478; 510/488; 510/501; 510/507; 510/509

(58) Field of Search ..... 510/298, 334, 510/446, 478, 488, 501, 507, 509

(56) References Cited

U.S. PATENT DOCUMENTS

| | | | | | |
|---|---|---|---|---|---|
| 3,936,537 | A | | 2/1976 | Baskerville, Jr. et al. | 427/242 |
| 3,959,155 | A | | 5/1976 | Montgomery et al. | 252/8.8 |
| 4,062,647 | A | | 12/1977 | Storm et al. | 8/137 |
| 4,141,841 | A | * | 2/1979 | McDanald | 510/330 |
| 4,196,104 | A | * | 4/1980 | Oguagha | 510/330 |
| 4,256,599 | A | * | 3/1981 | Krisp et al. | 252/99 |
| 4,472,287 | A | * | 9/1984 | Ramachandran et al. | 252/8.7 |
| 4,543,204 | A | | 9/1985 | Gervasio | 252/531 |
| 4,885,101 | A | * | 12/1989 | Tai | 252/8.6 |
| 5,061,397 | A | * | 10/1991 | Goodman | 510/334 |
| 5,366,652 | A | * | 11/1994 | Capeci et al. | 510/444 |
| 5,731,279 | A | * | 3/1998 | Pancheri | 510/340 |
| 5,900,399 | A | * | 5/1999 | Seiter et al. | 510/446 |
| 5,955,419 | A | * | 9/1999 | Barket, Jr. et al. | 510/507 |
| 6,069,124 | A | * | 5/2000 | Appel et al. | 510/438 |

FOREIGN PATENT DOCUMENTS

| | | | |
|---|---|---|---|
| CH | 652302 | * | 11/1985 |
| EP | 026 528 | | 4/1981 |
| EP | 210 842 | | 2/1987 |
| EP | 466 484 | | 1/1992 |
| EP | 522 766 | | 1/1993 |
| EP | 711 827 | | 5/1996 |
| EP | 0799886 | * | 10/1997 |
| EP | 799 886 | | 10/1997 |
| EP | 0 812 808 | * | 12/1997 |
| EP | 838 519 | | 4/1998 |
| EP | 1 035 199 | | 9/2000 |
| GB | 2 145 109 | | 3/1985 |
| JP | 09087696 | * | 3/1997 |
| WO | 96/14383 | | 5/1996 |
| WO | 96/14384 | | 5/1996 |
| WO | 96/24656 | | 8/1996 |
| WO | 99/40171 | | 8/1999 |
| WO | 00/43488 | | 7/2000 |
| WO | 00/44869 | | 8/2000 |

OTHER PUBLICATIONS

Derwent Abstract of JP 09087696, Mar. 31, 1997.

* cited by examiner

*Primary Examiner*—Lorna M. Douyon
(74) *Attorney, Agent, or Firm*—Rimma Mitelman

(57) ABSTRACT

A tablet of a compacted particulate composition for use in fabric washing contains detergent-active, detergency builder and other ingredients, characterized in that the tablet contains:

(i) a smectite clay mineral; and (ii) a material with a water-solubility which exceeds 50 gm per 100 gm of water at 20° C., and (iii) 0.5 to 40% by weight of an anionic surfactant.

14 Claims, No Drawings

DETERGENT COMPOSITIONS

This invention relates to detergent compositions in the form of tablets for use in fabric washing. Such tablets have the advantage that they do not require the user to measure out a volume of powder or liquid. Instead one or several tablets provide an appropriate quantity of composition for washing a single load in a washing machine or possibly by hand. They are thus easier for the consumer to handle and dispense.

Detergent compositions in tablet form have been described in a number of documents and are sold commercially.

Such tablets are generally made by compressing or compacting a quantity of detergent composition in particulate form. It is desirable that tablets should have adequate mechanical strength when dry, before use, yet disintegrate and disperse/dissolve quickly when added to wash water. Prior literature, including our EP-A-522766, has pointed out that there is difficulty in achieving both properties simultaneously, especially with compositions containing insoluble detergency builder such as aluminosilicate. As more pressure is used when a tablet is compacted, so the tablet density and strength rise, but there is also a reduction in the speed of disintegration/dissolution when the tablet comes into contact with wash water at the time of use. Organic detergent-active serves as a binder, but a typical quantity of such detergent can also retard disintegration and dissolution of a tablet.

It is possible to improve the speed of disintegration of tablets when placed in wash water, while retaining strength, by including a material of high solubility in water. Some tablets which have been sold commercially incorporate urea for this purpose. Our EP-A-711827 teaches the use of sodium citrate, and our later EP-A-838 519 discloses the use of sodium acetate trihydrate for the same purpose. However, such disintegration aids have no other function in the wash liquor after acting as a disintegration aid. There is therefore, furthermore, a need to provide a tablet which has acceptable disintegration and tablet characteristics and which has a high level of functional ingredients.

Certain clays with ion exchange properties are known to be effective as fabric softeners, and are described in U.S. Pat. No. 4,062,647, EP 26528-A, U.S. Pat. No. 3,959,155 and U.S. Pat. No. 3,936,537. Also clays have been disclosed for use as bodying agents in detergent laundry bars (as described in GB 2 145 109) and also for use in clear personal wash bars (as described in EP 210 842). A few documents have mentioned the possible use of such clay minerals in tablets, in certain limited circumstances.

WO 96/14384 is principally concerned with detergent compositions in powder form. It teaches the placing of a clay mineral in close proximity to, and preferably in the same granule as, an organic peroxyacid bleach to prevent patchy discolouration by the bleach. It also briefly mentions the possibility of using such a system in tablets.

JP 09/087696 discloses compacted particulate material tablets which are based on nonionic surfactant. These tablets contain a clay mineral and a disintegration parameter.

WO96/24656 describes the synergistic fabric softening effect achieved by a combination of a clay mineral with zeolite MAP (a zeolite P with silicate to aluminium ratio no greater than 1.33), and again mentions the possibility of using this system in tablets.

We have now found that smectite clay minerals can be incorporated in tablets as a partial replacement for the materials of high solubility which have been taught as aids to the rapid disintegration of tablets. When this is done, there is little or no adverse effect on the combination of strength and speed of disintegration.

In consequence, there can be a net benefit. The clay can provide a benefit of fabric softening or conditioning and serves to replace another material which does not give a benefit after the tablets have disintegrated.

The present invention provides a tablet of a compacted particulate composition for use in fabric washing which contains detergent-active, detergency builder and other ingredients, characterised in that the tablet contains:

(i) a smectite clay mineral; and (ii) a material with a water-solubility which exceeds 50 gm per 100 gm of water at 20° C., and (iii) 0.5 to 40% by weight of an anionic surfactant.

This combination of the material of high water-solubility with the smectite clay mineral acts to aid disintegration of a tablet in which they are present, without significantly reducing the strength of the tablet.

In a second aspect, the invention further provides the use of a smectite clay mineral in a tablet of compacted particulate composition for use in fabric washing as a tablet disintegration aid.

Most preferably the smectite clay is used in combination with a material of a water-solubility as stated above.

All percentages referred to herein are to percentages by weight based on the total weight of the composition unless otherwise stated.

Preferably, the tablet contains from 5 to 50 wt % detergent-active, from 15% to 70 wt % detergency builder, from 0.5% to 40 wt % of the smectite clay mineral and from 5% to 40 wt % of the material with water-solubility which exceeds 50 gm per 100 gm of water at 20° C. The upper limit of the amount of the material with high water-solubility may be 30 wt %, more preferably 20 or 15 wt %. The lower limit may be 8 wt % or even 10 wt %. The total amount of the clay mineral and the material of high water-solubility may be between 5.5 and 40 wt %, preferably no more than 25 or 30 wt %. The lower limit may be as high as 10% or 15 wt %.

It is further preferred that the smectite clay mineral is a fabric softening smectite clay with a ion exchange capacity of at least 50, or more preferably 70 meq/100 g of dry clay. The cation exchange capacity of a clay relates to the expandable properties of the clay and to the charge of the clay, and is conventionally measured by electrodialysis or by exchange with ammonium ions followed by titration. These procedures are set out in Grimshaw, "The Chemistry and Physics of Clays", pp. 264–265, Interscience (1971).

Another preferred feature of the present invention is that the tablets contain from 15 to 60 wt % of water-insoluble builder.

It is further preferred that the ratio of clay mineral to material with a water-solubility which exceeds 50 gm per 100 gm of water at 20° C. is between 1:1 and 1:10.

Materials for use in this invention, and preferred amounts and other features which may be used will be discussed in more detail below.

Smectite Clay Minerals

This invention utilises smectite clay minerals to promote disintegration of a tablet in water. Smectites are 2:1 clay minerals in which aluminium oxide or magnesium are present in a silicate lattice.

Suitable smectite clay minerals include montmorillonite, beidellite, hectorite, nontronite, saponite and sauconite, particularly those having an alkali or alkaline earth metal ion between the clay mineral layers. Montmorillonite is the preferred mineral, and clays which contain a majority of montmorillonite, such as bentonite, are a preferred source of this clay mineral. It may be preferred that the clay is at least 90% montmorillonite. Bentonites containing calcium or sodium montmorillonite (known as calcium or sodium bentonites) are particularly preferred.

Suitable bentonite clays are sold under the trade names of Laundrosil DW, M630 Agglomerat and EX 0276 Agglomerat clays available from Süd Chemie, Germany, Detercal G1 FC and Detercal G2 FC clays, available from Laviosa, Italy, Bentonite QPC 200G and QTIC 200G clay available from Colin Stewart Minerals, UK.

It is preferred that the majority of the clay particles have a particle size between 0.35 mm and 0.71 mm. It is further preferred that 90% of the clay particles have diameters between 0.35 mm and 0.71 mm.

The clay mineral is preferably present at a level from 0.5 to 40% by weight of the tablet, these percentages referring to the level of the clay mineral per se. The upper limit on the level of clay mineral may be as low as 8 wt %, 10 wt %, 15 wt %, 20 wt % or 30 wt %, with 15 wt % being particularly preferred. The lower limit on the level of clay mineral may be 1 or 3 wt %, or even 5 wt %. In situations where the clay mineral is provided in an impure form, e.g. unprocessed, the amount of the impure clay material may necessarily be higher than the limits for the clay mineral itself.

Clays are available in which the amount of crystalline used silica is below 5 wt %, and these are suitable for use in the present invention. It may be preferred that in the present invention the chromium, nickel and cobalt levels in the tablet, which usually arise due to these trace elements being found in clays, are less than 5 ppm.

Materials with High Water-solubility

The tablets of the invention contain a material which has a solubility in deionised water at 20° C. of at least 50 grams per 100 grams of water.

This material may be present in an amount which is at least 5 wt %, 7 wt % or 12 wt % of the tablet. Some of the material may be present in the base powder used to make the complete tablet formulation, whilst the remainder, preferably the majority, is added as a post-dosed ingredient to the base powder before tableting. It is preferred that at least 75 wt % or even 85 wt % of the material is not in the base powder, but is added as a post-dosed ingredient.

A solubility of at least 50 grams per 100 grams of water at 20° C. is an exceptionally high solubility: many materials which are classified as water soluble are less soluble than this.

Some highly water-soluble materials which may be used are listed below, with their solubilities expressed as grams of solid required to form a saturated solution in 100 grams of water at 20° C.:

| Material | Water Solubility (g/100 g) |
|---|---|
| Sodium citrate dihydrate | 72 |
| Potassium carbonate | 112 |
| Urea | >100 |
| Sodium acetate (anhydrous) | 119 |
| Sodium acetate trihydrate | 76 |

-continued

| Material | Water Solubility (g/100 g) |
|---|---|
| Magnesium sulphate $7H_2O$ | 71 |
| Potassium acetate | >200 |

By contrast the solubilities of some other common materials at 20° C. are:

| Material | Water Solubility (g/100 g) |
|---|---|
| Sodium chloride | 36 |
| Sodium sulphate decahydrate | 21.5 |
| Sodium carbonate anhydrous | 8.0 |
| Sodium percarbonate anhydrous | 12 |
| Sodium perborate anhydrous | 3.7 |
| Sodium tripolyphosphate anhydrous | 15 |

Preferably this highly water-soluble material is incorporated as particles of the material in a substantially pure form (i.e. the majority of such particles contain over 95% by weight of the material). However, the said particles may contain material of such solubility in a mixture with other material, provided that material of the specified solubility provides at least 50% by weight of these particles.

The preferred materials of high water-solubility are sodium citrate dihydrate, potassium carbonate, urea, sodium acetate in its anhydrous or trihydrate form, sodium acetate which is partially hydrated—as can be the case when it is spray dried, magnesium sulphate $7H_2O$ and potassium acetate. Mixtures of these can also be used. The most preferred of the aforementioned materials are sodium citrate dihydrate, sodium acetate in either its anhydrous, trihydrate or partially hydrated form. Mixtures of these most preferred materials can also be used.

Detergent-actives

Compositions which are compacted in tablets of this invention contain one or more detergent-actives. In a fabric washing composition, these preferably provide from 5% to 50% by weight of the overall tablet composition, more preferably from 8 or 9% by weight of the overall composition up to 25, 40 or 50% by weight. The detergent-active may be anionic (soap or non-soap), cationic, zwitterionic, amphoteric, nonionic or any combination of these. Many suitable detergent surfactants are commercially available and are fully described in the literature, for example in "Surface Active Agents and Detergents", Volumes I and II, by Schwartz, Perry and Berch.

Anionic surfactant is present in an amount of from 0.5 to 40% by weight, preferably from 2% or 4% up to 20%, 30% or 40% by weight of the tablet composition.

Synthetic (i.e. non-soap) anionic surfactants are well known to those skilled in the art. Examples include alkylbenzene sulphonates, particularly sodium linear alkylbenzene sulphonates having an alkyl chain length of $C_8$–$C_{15}$; olefin sulphonates; alkane sulphonates; dialkyl sulphosuccinates; and fatty acid ester sulphonates.

Primary alkyl sulphate having the formula $ROSO_3^- M^+$ in which R is an alkyl or alkenyl chain of 8 to 18 carbon atoms especially 10 to 14 carbon atoms and $M^+$ is a solubilising cation, is commercially significant as an anionic surfactant. Linear alkyl benzene sulphonate of the formula;

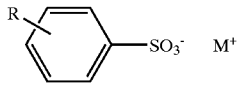

where R is linear alkyl chain of 8 to 15 carbon atoms and $M^+$ is a solubilising cation, especially sodium, is also a commercially significant anionic surfactant.

Frequently, such linear alkyl benzene sulphonate or primary alkyl sulphate of the formula above, or a mixture thereof, will be the desired anionic surfactant and may provide 75 to 100 wt % of any anionic non-soap surfactant in the composition.

In some forms of this invention the amount of non-soap anionic detergent lies in a range from 5 to 20 wt % of the tablet composition.

It may also be desirable to include one or more soaps of fatty acids. These are preferably sodium soaps derived from naturally occurring fatty acids, for example, the fatty acids from coconut oil, beef tallow, sunflower or hardened rapeseed oil.

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl ($C_{8-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylene-diamine. Other nonionic detergent compounds include alkylpolyglycosides, long-chain amine oxides, tertiary phosphine oxides, and dialkyl sulphoxides.

Especially preferred are the primary and secondary alcohol ethoxylates, especially the $C_{9-11}$ and $C_{12-15}$ primary and secondary alcohols ethoxylated with an average of from 5 to moles of ethylene oxide per mole of alcohol.

In certain forms of this invention the amount of nonionic detergent lies in a range from 4 to 40 wt %, better 4 or 5 to 30 wt % by weight of the composition.

Many nonionic detergent-active compounds are liquids.

These may be absorbed on a porous carrier or on particles of the composition. Preferred carriers include zeolite; zeolite granulated with other materials, for example Wessalith CS (Trade Mark), Wessalith CD (Trade Mark) or Vegabond GB (Trade Mark); sodium perborate monohydrate.

Burkeite (spray-dried sodium carbonate and sodium sulphate as disclosed in EP-A-221776 of Unilever); and layered sodium silicate as described in U.S. Pat. No. 4,664,839.

Amphoteric or zwitterionic detergent compounds may also be used in the compositions of the present invention, but this is not normally desired due to their relatively high cost. If any amphoteric or zwitterionic detergent compositions are used it is generally in small amounts in compositions which are based on the much more commonly used synthetic anionic and/or nonionic detergent compositions.

Detergency Builder

The detergency builder is preferably present in an amount of 15 wt %–70 wt %, more preferably from 15 to 60 wt %, eg. 20–55 wt %. Especially preferred are compositions comprising 15 to 60 wt % of water-insoluble detergency builder.

The detergency builder may be provided wholly by water-soluble materials, or may be provided in large part or even entirely by water-insoluble materials with water-softening properties.

Alkali-metal aluminosilicates are strongly favoured as environmentally acceptable water-insoluble builders for fabric washing. Alkali metal (preferably sodium) aluminosilicates may be either crystalline, amorphous or mixtures thereof, having the general formula:

$$0.8\text{–}1.5\ Na_2O.Al_2O_3.0.8\text{–}6\ SiO_2.xH_2O$$

These materials contain some bound water (indicated as "$xH_2O$") and are required to have a calcium ion exchange capacity of at least 50 mg CaO/g. The preferred sodium aluminosilicates within the above formula contain 1.5–3.5 $SiO_2$ units. Both amorphous and crystalline aluminosilicates can be prepared by reaction between sodium silicate and sodium aluminate, as amply described in the literature.

Suitable crystalline sodium aluminosilicate ion-exchange detergency builders are described, for example, in GB 1429143 (Procter & Gamble). The preferred sodium aluminosilicates of this type are the well known commercially available zeolites A and X, the novel zeolite P described and claimed in EP 384070 (Unilever) and mixtures thereof.

Conceivably a water-insoluble detergency builder could be a layered sodium silicate as described in U.S. Pat. No. 4,664,839. NaSKS-6 is the trademark for a crystalline layered silicate marketed by Hoechst (commonly abbreviated as "SKS-6"). NaSKS-6 has the delta-$Na_2SiO_5$ morphology form of layered silicate. It can be prepared by methods such as described in DE-A-3417649 and DE-A-3742043. Other such layered silicates, such as those having the general formula $NaMSi_xO_{2x+1}\cdot_yH_2O$ wherein M is sodium or hydrogen, x is a number from 1.9 to 4, preferably 2, and y is a number from 0 to 20, preferably 0 can be used.

Water-soluble phosphorous-containing inorganic detergency builders, include the alkali-metal ortophosphates, metaphosphates, pyrophosphates and polyphosphates. Specific examples of inorganic phosphate builders include sodium and potassium tripolyphosphates, orthophosphates and hexametaphosphates.

Non-phosphorous water-soluble builders may be organic or inorganic. Inorganic builders that may be present include alkali metal (generally sodium) carbonate; while organic builders include polycarboxylate polymers, such as polyacrylates, acrylic/maleic copolymers, and acrylic phosphonates, monomeric polycarboxylates such as citrates, gluconates, oxydisuccinates, glycerol mono- di- and trisuccinates, carboxymethyloxysuccinates, carboxymethyloxymalonates, dipicolinates and hydroxyethyliminodiacetates.

Tablet compositions preferably include polycarboxylate polymers, more especially polyacrylates and acrylic/maleic copolymers which can function as builders and also inhibit unwanted deposition onto fabric from the wash liquor. Nitrilo triacetate may also be used as the builder. The trisodium salt is especially preferred.

Bleach System

Tableted detergent compositions according to the invention may contain a bleach system. This preferably comprises one or more peroxy bleach compounds, for example, inorganic persalts or organic peroxyacids, which may be employed in conjunction with activators to improve bleaching action at low wash temperatures. If any peroxygen compound is present, the amount is likely to lie in a range from 10 to 25% by weight of the composition.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), which is now in widespread commercial use in conjunction with sodium perborate; and perbenzoic acid precursors. The quaternary ammonium and phosphonium bleach activators disclosed in U.S. Pat. No. 4,751,015 and U.S. Pat. No. 4,818,426 (Lever Brothers Company) are also of interest. Another type of bleach activator which may be used, but which is not a bleach precursor, is a transition metal catalyst as disclosed in EP-A-458397, EP-A-458398 and EP-A-549272. A bleach system may also include a bleach stabiliser (heavy metal sequestrant) such as ethylenediamine tetramethylene phosphonate and diethylenetriamine pentamethylene phosphonate.

As indicated above, if a bleach is present and is a water-soluble inorganic peroxygen bleach, the amount may well be from 10% to 25% by weight of the composition.

Other Detergent Ingredients

The detergent tablets of the invention may also contain one of the detergency enzymes well known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), and Savinase (Trade Mark), as supplied by Novo Industri A/S, Copenhagen, Denmark. Detergency enzymes are commonly employed in the form of granules or marumes, optionally with a protective coating, in amount of from about 0.1% to about 3.0% by weight of the composition; and these granules or marumes present no problems with respect to compaction of a detergent composition to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis-(2-morpholino-4-anilino-s-triazin-6-ylamino) stilbene disulphonate; and Tinopal CBS is disodium 2,2'-bis-(phenylstyryl) disulphonate.

An antifoam material is advantageously included, especially if the detergent tablet is primarily intended for use in front-loading drum-type automatic washing machines. Suitable antifoam materials are usually in granular form, such as those described in EP 266863A (Unilever). Such antifoam granules typically comprise a mixture of silicone oil, petroleum jelly, hydrophobic silica and alkyl phosphate as antifoam active material, sorbed onto a porous absorbed water-soluble carbonate-based inorganic carrier material. Antifoam granules may be present in an amount up to 5% by weight of the composition.

The detergent tablets of the invention may also contain a perfume composition. The perfume composition will normally consist of a plurality of perfumery materials having a fragrance, and may include a minor proportion (less than 50% by weight of the perfume) of odourless organic solvent which serves as a carrier. Perfume compositions suitable for use in fabric washing have been disclosed in various documents including EP 332259 (Procter) and are available from perfume houses such as Quest International, Naarden, Netherlands. A perfume composition may have deodorant properties, as disclosed in U.S. Pat. No. 4,304,679, U.S. Pat. No. 4,663,068, U.S. Pat. No. 5,501,805 and U.S. Pat. No. 5,554,588.

The total amount of perfume in a tablet is likely to be from 0.1 to 5% by weight of the tablet, preferably from 0.1 to 2%. In many fabric washing products, the amount of perfume is less than 1%. The total amount of perfume in a tablet may therefore be in a range from 0.1 to 0.5%.

Further ingredients which can optionally be employed in the detergent tablet of the invention include anti-redeposition agents such as sodium carboxymethylcellulose, straight-chain polyvinyl pyrrolidone and the cellulose ethers such as methyl cellulose and ethyl hydroxyethyl cellulose, heavy metal sequestrants such as EDTA, and colorants or coloured speckles.

Other Fabric Softeners

Although the clay mineral in the tablet acts as a fabric softener, it may be desirable to use additional fabric softening agents, although the invention includes tablets where the clay minerals are the only fabric softeners. The total amount of fabric softening agents, including the amount of clay minerals, in the tablets of the invention will, in general, be from 0.5 or 3 wt % up to 30 or 50 wt % of the tablet. The lower limit may be as high as 5 wt % and the upper limit as low as 10 wt %.

A discussion of materials which are known as fabric softening agents and which may be used in the tablets of the present invention is found in WO 94/24999.

Many suitable and commercially important fabric softening agents are organic compounds containing quaternary nitrogen and at least one carbon chain of 6 to 30 carbon atoms, e.g. in an alkyl, alkenyl or aryl substituted alkyl or alkenyl group with at least six aliphatic carbon atoms. Other suitable fabric softening agents are the analogous tertiary amines and imidazolines, other aliphatic alcohols, esters, amines or carboxylic acids incorporating a $C_8$ to $C_{30}$ alkyl, alkenyl or acyl group, including esters of sorbitan and esters of polyhydric alcohols, and mineral oils. Certain clays are important as fabric softening agents. Another class of materials used as fabric softening agents are hydrophobically modified cellulose ethers.

Some specific instances of fabric softening agents which may be used in tablets of the present invention are:

(1) Acyclic quaternary ammonium compounds wherein two N-substituents are hydrocarbyl groups containing from 15 to 22 carbon atoms, the third N-substituent is a saturated alkyl or hydroxy alkyl group containing from 1 to 4 carbon atoms, and the fourth substituent may be defined as for either of the other substituents or may be phenyl. The counter-anion is preferably selected from halide, methyl sulphate and ethyl sulphate radicals.

Throughout this discussion of fabric softening agents, the expression hydrocarbyl group refers to alkyl or alkenyl groups optionally substituted or interrupted by functional groups such as —OH, —O—, COHN, —COO— etc.

Representative examples of these quaternary softeners include ditallow dimethyl ammonium chloride; di(hydrogenated tallow) dimethyl ammonium chloride; di(coconut) dimethyl ammonium chloride; di(coconut) dimethyl ammonium methosulphate.

(2) Ester Quaternary Ammonium Salts

A number of quaternary ammonium salts containing ester groups, including those disclosed in FR-A-2054337

(BASF), EP-A-345842 A2 (Procter), EP-A-239910 (Procter) and U.S. Pat. No. 4,137,180 (Lever) are suitable for use in the tablets of the present invention. Examples of suitable materials include N,N-di(tallowyl-oxyethyl), N-methyl, N-hydroxyethyl ammonium chloride and 1,2-ditallowyloxy-3-trimethyl ammoniopropane chloride. In these materials, tallowyl may be replaced with cocoyl, palmoyl, lauryl, oleyl, stearyl and palmityl groups.

3) Quaternary Imidazolinium Salts

A further class of cationic softener materials is the imidazolinium salts of generic formula (I)

(I)

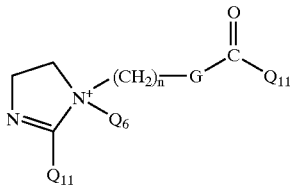

X wherein $Q_{11}$ is a hydrocarbyl group containing from 6 to 24 carbon atoms, G is —N(H)—, or —O—, or —$NQ_2$—, n is an integer between 1 and 4, and $Q_2$ and $Q_6$ are as defined above.

Preferred imidazolinium salts include 1-methyl-1-(tallowylamido) ethyl-2-tallowyl-4,5 dihydro imidazolinium methosulphate and 1-methyl-1-(palmitoylamido) ethyl-2-octadecyl-4,5-dihydroimidazolinium chloride. Other useful imidazolinium materials are 2-heptadecyl-1-methyl-1-(2 stearylamido) ethyl imidazolinium chloride and 2-lauryl-1-hydroxyethyl-1-oleyl imidazolinium chloride. Also suitable are the imidazolinium fabric softening components of U.S. Pat. No. 4,127,489.

4) Primary, Secondary and Tertiary Amines.

Primary, secondary and tertiary amines are useful as softening agents. One N-substituent is a hydrocarbyl group containing from 6 to 24 carbon atoms, the second N-substituent is hydrogen or a hydrocarbyl group containing from 1 to 22 carbon atoms and the third N-substituent can be hydrogen or a hydrocarbyl group containing from 1 to 6 carbon atoms. Preferably amines are protonated with hydrochloric acid, orthophosphoric acid or citric acid or any other similar acids for use in cleaning compositions of the present invention. Specific examples of tertiary amines that are suitable for use in the tablets of the present invention are those disclosed in EP 213720 (Unilever).

5) Cellulase

British Patent Specification GB 1 368 599 (Unilever) discloses the use of cellulolytic enzymes, i.e. cellulases, as harshness reducing agents. It is thought that cellulase achieves its anti-harshening effect on, e.g. cotton, by cleaving the cellulosic fibrils which form on the cotton fibres during the normal washing process. This cleavage prevents the fibrils from bonding together and thereby introducing a degree of rigidity into the fabric.

It is preferred to use cellulases which have an optimum activity at alkaline pH values, such as those described in British Patent Specifications GB 2 075 028 A (Novo Industrie A/S), GB 2 095 275 A (Kao Soap Co Ltd) and GB 2 094 826 A (Kao Soap Co Ltd).

Examples of such alkaline cellulases are cellulases produced by a strain of *Humicola insolens* (*Humicola grisea var. thermoidea*), particularly the *Humicola strain* DSM 1800, cellulases produced by a fungus of Bacillus N or a cellulase 212-producing fungus belonging to the genus Aeromanas, and cellulase extracted from the hepatopancreas of a marine mollusc (*Dolabella Auricula Solander*).

The amount of cellulase in a tablet of the invention will, in general, be from 0.1 to 10% by weight. In terms of cellulase activity the use of cellulase in an amount corresponding to from 0.25 to 150 or higher regular $C_x$ units/gram of detergent composition is within the preferred scope of the present invention. A most preferred range of cellulase activity, however, is from 0.5 to 25 regular $C_x$ units/gram of the detergent composition.

Particle Size and Distribution

A detergent tablet of this invention, or a discrete region of such a tablet, is a matrix of compacted particles.

Preferably the particulate composition has an average particle size in the range from 200 to 2000 $\mu$m, more preferably from 250 to 1400 $\mu$m. Fine particles, smaller than 180 $\mu$m or 200 $\mu$m may be eliminated by sieving before tableting, if desired, although we have observed that this is not always essential.

Tableting

Tableting entails compaction of a particulate composition. A variety of tableting machinery is known, and can be used. Generally it will function by stamping a quantity of the particulate composition which is confined in a die.

Manufacture of a tablet with two layers of differing composition may be carried out by placing a predetermined quantity of one composition in a mould, then adding a second composition on top, and next driving a die into the mould to cause compression.

Alternatively, a predetermined quantity of a first composition may be placed in a mould and compacted by driving a die into the mould, followed by removing the die, adding a second composition and compacting again.

Tableting machinery able to carry out such operations is known. For example, suitable tablet presses are available from Fette and from Korsch.

Tableting may be carried out at ambient temperature or at a temperature above ambient which may allow adequate strength to be achieved with less applied pressure during compaction. In order to carry out the tableting at a temperature which is above ambient, the particulate composition is preferably supplied to the tableting machinery at an elevated temperature. This will of course supply heat to the tableting machinery, but the machinery may be heated in some other way also.

It is known to make tablets using microwave radiation. WO 96/06156 mentions that hydrated materials are useful in this special circumstance to cause sintering.

For the present invention, if any heat is supplied, it is envisaged that this will be supplied conventionally, such as by passing the particulate composition through an oven, rather than by any application of microwave energy.

The size of a tablet will suitably range from 10 to 160 grams (gm), preferably from 15 to 60 gm, depending on the conditions of intended use, and whether the tablet represents a dose for an average load in a fabric washing or a fractional part of such a dose. The tablets may be of any shape. However, for ease of packaging they are preferably blocks of substantially uniform cross-section, such as cylinders or cuboids. The overall density of a tablet is preferably 1040 or 1050 gm/litre, better 1100 gm/litre, up to 1300 or 1350 gm/litre or even more. The tablet density may well lie in a range up to no more than 1250 or even 1200 gm/litre.

While the starting particulate composition may in principle have any bulk density, the present invention is especially relevant to tablets made by compacting powders of relatively high bulk density, because of their greater tendency to exhibit disintegration and dispersion problems. Such tablets have the advantage that, as compared with a tablet derived from a low bulk density powder, a given dose of composition can be presented as a smaller tablet.

Thus the starting particulate composition may suitably have a bulk density of at least 400 g/litre, preferably at least 500 g/litre, and advantageously at least 700 g/litre. Granular detergent compositions of high bulk density prepared by granulation and densification in a high-speed mixer/granulator, as described and claimed in EP 340013A (Unilever), EP 352135A (Unilever), and EP 425277A (Unilever), or by the continuous granulation/densification processes described and claimed in EP 367339A (Unilever) and EP 390251A (Unilever), are inherently suitable for use in the present invention.

Preferred embodiments of the invention will now be described by way of example only. Further modification within the scope of the present invention will be apparent to the person skilled in the art.

Experimental Methods

The strength and dissolution times of tablets made were tested as follows.

The strength of the tablets, in their dry state, was determined using an Instron 5566 (available from Namas) and calculated as a Diametrical Fracture Stress (DFS) using the following formula:

$$DFS = \frac{2F}{\pi DH}$$

where F is the breaking force, D is the diameter of the tablet and H is the tablet thickness.

The speed of dissolution of the tablets was measured by a test procedure in which two of the tablets are placed on a plastic sieve with 2 mm mesh size which was immersed in 9 litres of demineralised water at ambient temperature of 22° C. and rotated at 200 rpm. The water conductivity was monitored over a period of 30 minutes or until it reached a constant value.

Example 1

Tablets having a weight of 40 gm were made using an Instron 5566 testing machine to compact a particulate composition into a cylindrical die of 44 mm in diameter. The tablets were made using two different compaction forces, 5.0 and 9.7 kN, and a compaction speed of 20 mm/min.

The tablets were made from one comparative composition and three compositions in accordance with this invention. All four tablets contained a granulated base powder, and other ingredients which were added (post-dosed) to the base powder. The tablets according to the invention included 3.2 gm (8% by weight of the tablet) of a respective one of three different clay minerals, whilst the amount of granulated base powder was reduced by a corresponding amount. The three clay minerals used were:

A Laundrosil DW—detergent bentonite agglomerate; a specially activated white sodium bentonite (90 wt %), coated with zeolite (10 wt %)

B EX M630 Aggl—a specially activated white sodium bentonite.

C EX 0276 Aggl—natural white calcium/magnesium bentonite (majority of bentonite in calcium form) which are all available from Sud Chemie, Germany.

The granulated base powder had the following composition:

| | wt % |
|---|---|
| Zeolite A24 | 57.1 |
| Soda Ash | 9.2 |
| Nonionic surfactant 3EO/7EO | 12.8 |
| Soap | 1.2 |
| NaLAS* | 12.3 |
| Sodium citrate dihydrate | 5.5 |
| Sodium Carboxy Methyl cellulase | 0.9 |
| Water | 1.0 |
| Total | 100 |

*Na LAS is sodium alkyl benzene sulphate

| | Comparative example A wt % | Examples 1a, b, c wt % |
|---|---|---|
| Base Powder | 52.50 | 44.50 |
| Clay mineral | — | 8.00 |
| Anti-foam granules | 1.54 | |
| Fluorescer | 1.03 | |
| Sodium acetate trihydrate | 19.05 | |
| AA/MA 70/30 copolymer | 1.03 | |
| Sodium silicate | 3.80 | |
| TAED | 5.66 | |
| Perborate monohydrate | 14.72 | |
| Organophosphate heavy metal sequestrant | 0.67 | |
| Total | 100.00 | 100.00 |

The strength and dissolution times were measured and are shown below

| | DFS (kPa) | Dissolution time (seconds) | | Dissolution time (seconds) |
|---|---|---|---|---|
| Compaction force | 5.0 kN | | 9.7 kN | |
| Comparative example A | 23.6 | 261 | 38.2 | 319 |
| Example 1a | 19.4 | 188 | 33.7 | 260 |
| Example 1b | 20.8 | 210 | 34.5 | 279 |
| Example 1c | 22.2 | 233 | 36.3 | 295 |

These results show that the clay minerals in combination with materials of high solubility, in this example both sodium citrate dihydrate and sodium acetate trihydrate, decrease the time for the tablet to dissolve without having a significant adverse effect on the tablet strength.

Example 2

Comparative tablets were made as in example 1, but with a weight of 42 gm (comparative A'). The tablets of the invention were made by adding 3.4 gm of a clay mineral to the ingredients of the comparative tablet to produce 45.4 g tablets. Four different clay minerals were used with the letters corresponding to the example letters:

a Laundrosil DW—see above(Sud Chemie, Germany)

b Bentonite QPC 200G—white agglomerate, calcium based (Stewart Minerals, UK)

c Detercal G1 FC—sodium/calcium bentonite (Laviosa, Italy)

d Detercal G2 FC—sodium/calcium bentonite (Laviosa, Italy)

The tablets made had the following compositions:

| | Comparative Example | Examples 2a, 2b, 2c, 2d | |
|---|---|---|---|
| | A' wt % | parts per weight | wt % |
| Base Powder (as in Example 1) | 52.50 | 52.50 | 48.57 |
| Clay mineral | — | 8.00 | 7.49 |
| Anti-foam granules | 1.54 | 1.54 | 1.42 |
| Fluorescer | 1.03 | 1.03 | 0.95 |
| Sodium acetate trihydrate | 19.05 | 19.05 | 17.62 |
| AA/MA 70/30 copolymer | 1.03 | 1.03 | 0.95 |
| Sodium silicate | 3.80 | 3.80 | 3.52 |
| TAED | 5.66 | 5.66 | 5.23 |
| Perborate monohydrate | 14.72 | 14.72 | 13.62 |
| Organophosphate heavy metal sequestrant | 0.67 | 0.67 | 0.62 |
| Total | 100.00 | 108.00 | 100.00 |

The strength and dissolution times were measured and are shown below.

| | DFS (kPa) | Dissolution Time (seconds) | DFS (kPa) | Dissolution Time (seconds) |
|---|---|---|---|---|
| Compaction force | 5.0 kN | | 9.7 kN | |
| Comparative A' | 22.8 | 198 | 39.3 | 271 |
| Example 2a | 18.5 | 146 | 32.5 | 228 |
| Example 2b | 20.4 | 133 | 34.7 | 198 |
| Example 2c | 21.5 | 150 | 36.0 | 217 |
| Example 2d | 21.0 | 154 | 35.2 | 208 |

The results show that the tablets of the invention have faster dissolution times, in comparison to the comparative tablet A' which contains no clay mineral, yet they had similar tablet strengths.

Example 3

In a further experiment, carried out under slightly different ambient conditions to example 2, tablets having the composition of Example 2b were made, along with tablets having both lesser and greater amounts of the clay mineral Bentonite QPC 200G (clay mineral b in example 2). The compositions of are set out in the table below. The tablets were made with weights of 43.7 gm, 46 gm and 48.7 gm respectively, so that the weights of the ingredients other than the clay mineral was the same in all three tablets compared to the amount of clay in example 2b. Example 3a has a reduced amount of the clay material, example 3b has the same amount of the clay material and example 3c has an increased amount of the clay material.

| | Example 3a parts per weight | Example 3b Parts per weight | Example 3a Parts per weight |
|---|---|---|---|
| Base Powder | 52.50 | 52.50 | 52.50 |
| Clay mineral | 4.00 | 8.00 | 15.76 |
| Anti-foam granules | 1.54 | 1.54 | 1.54 |
| Fluorescer | 1.03 | 1.03 | 1.03 |

-continued

| | Example 3a parts per weight | Example 3b Parts per weight | Example 3a Parts per weight |
|---|---|---|---|
| Sodium acetate trihydrate | 19.05 | 19.05 | 19.05 |
| AA/MA 70/30 copolymer | 1.03 | 1.03 | 1.03 |
| Sodium silicate | 3.80 | 3.80 | 3.80 |
| TAED | 5.66 | 5.66 | 5.66 |
| Sodium perborate monohydrate | 14.72 | 14.72 | 14.72 |
| Organophosphate heavy metal sequestrant | 0.67 | 0.67 | 0.67 |
| Total | 104.00 | 108.00 | 115.76 |

| | Example 3a wt % | Example 3b wt % | Example 3c wt % |
|---|---|---|---|
| Base Powder | 50.46 | 48.57 | 45.28 |
| Clay mineral | 3.89 | 7.49 | 13.76 |
| Anti-foam granules | 1.48 | 1.42 | 1.33 |
| Fluorescer | 0.99 | 0.95 | 0.89 |
| Sodium acetate trihydrate | 18.31 | 17.62 | 16.43 |
| AA/MA 70/30 copolymer | 0.99 | 0.95 | 0.89 |
| Sodium silicate | 3.65 | 3.52 | 3.28 |
| TAED | 5.44 | 5.23 | 4.88 |
| Sodium perborate monohydrate | 14.15 | 13.62 | 12.69 |
| Organophosphate heavy metal sequestrant | 0.64 | 0.62 | 0.58 |
| Total | 100.00 | 100.00 | 100.00 |
| Ratio of clay: citrate & acetate | 1:7.5 | 1:2.7 | 1:1.4 |

The strength and dissolution times were measured, and are shown below.

| | % clay | DFS (kpa) | Dissolution Time (seconds) | DFS (kPa) | Dissolution Time (seconds) |
|---|---|---|---|---|---|
| Compaction force | | 5.0 kN | | 9.7 kN | |
| Example 3a | 3.89 | 20.6 | 190 | 35.0 | 290 |
| Example 3b | 7.49 | 21.3 | 174 | 36.1 | 255 |
| Example 3c | 13.76 | 20.5 | 147 | 35.6 | 228 |

These results illustrate that increasing the amount of clay mineral present in the formulation, decreases the dissolution time of the tablet, whilst the strength of the tablet is unaffected.

Example 4

As in Example 2, a comparative tablet (comparative example B) of 42 gm was made, but using a different granulated base powder; tablets according to the invention were made in which 3.4 gm of clay mineral was added to the ingredients of the comparative example and the resulting compositions were made into 45.4 gm tablets. All the tablets were cylindrical with a diameter of 44 mm. The clay minerals used were:

| | | |
|---|---|---|
| A | Laundrosil DW | (Sud Chemie, Germany) |
| B | Bentonite QPC 200G | (Stewart Minerals, UK) |
| C | Detercal G2 FC | (Laviosa, Italy) |

The granulated base powder was of the following formulation:

| | wt % |
|---|---|
| Zeolite A24 | 53.9 |
| Sodium acetate Ash | 6.1 |
| Nonionic surfactant 3EO/7EO | 9.2 |
| Soap | 1.6 |
| NaLAS | 20.9 |
| Sodium citrate dihydrate | 5.5 |
| Sodium carboxymethyl cellulose | 1.0 |
| Water | 1.8 |
| Total | 100.00 |

The tablets had the following composition:

| | | Examples 4a, 4b, 4c | |
|---|---|---|---|
| | Comparative Example B wt % | parts per weight | wt % |
| Base Powder | 46.27 | 46.27 | 42.80 |
| Clay mineral | 0.00 | 8.00 | 7.49 |
| Anti-foam granules | 1.85 | 1.85 | 1.71 |
| Flourescer | 0.98 | 0.98 | 0.91 |
| Soil release co-polymer | 1.13 | 1.13 | 1.05 |
| Sodium acetate trihydrate | 23.29 | 23.29 | 21.55 |
| AA/MA 70/30 copolymer | 1.34 | 1.34 | 1.24 |
| Sodium silicate | 3.06 | 3.06 | 3.33 |
| TAED | 5.24 | 5.24 | 4.85 |
| Sodium percarbonate | 15.63 | 15.63 | 14.45 |
| Organophosphate heavy metal sequestrant | 0.67 | 0.67 | 0.62 |
| Total | 100.00 | 108.00 | 100.00 |

The strength and dissolution times were measured and are shown below.

| | DFS (kPa) | Dissolution time (seconds) | DFS (kPa) | Dissolution time (seconds) |
|---|---|---|---|---|
| Compaction force | 5.0 kN | | 9.7 kN | |
| Comparative B | 29.6 | 175 | 48.3 | 301 |
| Example 4a | 21.5 | 118 | 38.9 | 285 |
| Example 4b | 30.4 | 149 | 51.0 | 238 |
| Example 4c | 29.2 | 142 | 52.9 | 228 |

These results again show that the addition of clay minerals enhances the speed of disintegration.

Example 5

Comparative tablets were made as in Example 4, but having a weight of 40 gm (comparative B'). 40 gm tablets of the invention were made in which 2 or 4 gm of Bentonite QPC 200G was added to the ingredients of the comparative example, with a corresponding reduction in the amount of sodium acetate trihydrate. The compaction speed used in this example was 500 mm/min.

| | Comp. B' wt % | Ex 5a wt % | Ex 5b wt % | Ex 5c wt % |
|---|---|---|---|---|
| Base powder (of Example 4 | 46.27 | 46.27 | 46.27 | 46.27 |
| QPC 200G clay | 0.00 | 5.00 | 10.00 | 15.00 |
| Sodium acetate trihydrate | 23.29 | 18.29 | 13.29 | 8.29 |
| Anti-foam granules | 1.85 | 1.85 | 1.85 | 1.85 |
| Fluorescer | 0.98 | 0.98 | 0.98 | 0.98 |
| Soil-release copolymer | 1.13 | 1.13 | 1.13 | 1.13 |
| AA/MA 70/30 copolymer | 1.34 | 1.34 | 1.34 | 1.34 |
| Sodium silicate | 3.6 | 3.6 | 3.6 | 3.6 |
| TAED | 5.24 | 5.24 | 5.24 | 5.24 |
| Sodium perborate monohydrate | 15.63 | 15.63 | 15.63 | 15.63 |
| Organophosphate heavy metal sequestrant | 0.67 | 0.67 | 0.67 | 0.67 |
| Total | 100.00 | 100.00 | 100.00 | 100.00 |
| Ratio of clay:acetate | | 1:4.2 | 1:1.6 | 1:0.55 |

The strength and dissolution times were measured and are shown below.

| | DFS (kPa) | Dissolution time (seconds) | DFS (kPa) | Dissolution time (seconds) |
|---|---|---|---|---|
| Compaction force | 5.0 kN | | 9.7 kN | |
| Comparative B' | 20.0 | 145 | 38.0 | 200 |
| Example 5a | 20.6 | 134 | 39.6 | 187 |
| Example 5b | 20.5 | 145 | 41.4 | 206 |
| example 5c | 26.23 | 175 | — | — |

Comparative Example 5A

Tablets were made with a base powder of the following composition:

| | wt. % |
|---|---|
| Zeolite A24 (anhydrous) | 46.7 |
| Sodium acetate (anhydrous) | 3.6 |
| Nonionic surfactant 3EO/7EO | 9.2 |
| Soap | 1.6 |
| NaLAS | 20.8 |
| Sodium carbonate (anhydrous) | 6.7 |
| Sodium carboxymethyl cellulose | 0.6 |
| Water and other minor ingredients | 10.8 |
| Total | 100.00 |

This powder was mixed with other ingredients as tabulated below.

| | Tablet I wt. % | Tablet II wt. % |
|---|---|---|
| Base powder | 50.07 | 50.07 |
| Sodium percarbonate | 15.00 | 15.00 |
| Soil release polymer | 1.09 | 1.09 |

-continued

| | Tablet I wt. % | Tablet II wt. % |
|---|---|---|
| Fluorescer | 1.24 | 1.24 |
| Anti-foam granules | 1.79 | 1.79 |
| AA/MA 70/30 copolymer | 1.19 | 1.19 |
| TAED | 5.06 | 5.06 |
| Organophosphate heavy metal sequestrant | 0.73 | 0.73 |
| Sodium disilicate | 3.18 | 3.18 |
| Coloured speckles | 1.39 | 1.39 |
| Enzymes | 0.88 | 0.88 |
| Perfume | 0.38 | 0.38 |
| Sodium acetate trihydrate | 18.00 | 8.10 |
| Sodium carbonate | — | 9.90 |

42.5 g portions of each composition were made into cylindrical tablets of 44 mm diameter, using a Grasby Specac labscale tablet press with varying compaction force.

The strength of the tablets ($F_{max}$), in their dry state as made on the press, was determined as the force, expressed in Newtons, needed to break the tablet, as measured using a Chatillon type universal testing instrument in a direction perpendicular to the direction of compression. The desired tablet strength was 59 N, although tablet I was made with two different strengths, one below and one above 59 N. The results below include a linear interpolation of the results for tablet I to give a predicted value for the dissolution time at $F_{max}$=59 N.

| Tablet | NaAc.3aq (wt. %) | $T_{90}$ (minutes) (at $F_{max}$ = 59 N) |
|---|---|---|
| I | 18.0 | 2.04+ |
| II | 8.1 | 3.70 |

+linear interpolation of Fmax = 43.8N, $T_{90}$ = 1.80 minutes and $F_{max}$ = 62.8N. $T_{90}$ – 2.10 minutes These results show that replacing sodium acetate trihydrate in a tablet with another, less water-soluble salt (sodium carbonate) causes a significant increase in the dissolution time of the tablet. In contrast, the results of example 5 show that sodium acetate trihydrate can be replaced by clay mineral without any significant change in the tablet dissolution time or tablet strength.

Example 6

Two types of two-layered tablets and one type of single layer tablet, all with a weight of 42.5 gm, were made, using the same granulated base powder as comparative example B. The two-layered tablets had one layer (layer A) which provided 25% of their total weight. Layer B provided the rest. In the first two-layered tablet (example 6a) the bleach activator and clay were in one layer (layer A) and the bleach was in the other layer; the second two-layer tablet (example 6b) had bleach and activator in both layers. For both types of two-layered tablet, one layer was precompacted with a force of 5 kN, the composition for the second layer was added to the mould and a greater compaction force of 9.7 kN was applied. The compaction speed during these experiments was 500 mm/min.

| | Separation of Peroxyacid (Example 6a) | | No separation (Example 6b) | | Comparative Example C |
|---|---|---|---|---|---|
| Components Layer | A wt % | B wt % | A wt % | B wt % | Single wt % |
| Base powder | 50.43 | 49.24 | 42.45 | 46.64 | 46.64 |
| QPC 200G (Clay) | 29.63 | — | 29.63 | — | — |
| Anti-foam granules | — | 1.97 | 1.70 | 1.87 | 1.87 |
| Fluorescer | — | 0.98 | 0.98 | 0.98 | 0.98 |
| Soil-release copolymer | — | 1.20 | 1.03 | 1.14 | 1.14 |
| AA/MA 70/30 copolymer | — | 1.42 | 1.22 | 1.35 | 1.35 |
| Sodium disilicate | — | 3.83 | 3.30 | 3.63 | 3.63 |
| TAED white | 19.94 | — | 4.81 | 5.29 | 5.29 |
| Sodium percarbonate | — | 15.79 | 14.33 | 14.95 | 14.95 |
| Organophosphate heavy metal sequestrant | — | 0.72 | 0.62 | 0.68 | 0.68 |
| Sodium acetate trihydrate | — | 24.79 | — | 23.47 | 23.47 |
| Total | 100 | 100 | 100 | 100 | 100 |

The strength and dissolution times were determined and are shown below.

| Tablet | Number of layers | DFS (kPa) | $t_{90}$ (S) dissolution time |
|---|---|---|---|
| TAED separation | 2 | 47.5 | 222 |
| No separation | 2 | 39.5 | 217 |
| Comparative Example C | 1 | 34.7 | 213 |

The results show that for similar dissolution times, separation of TAED from the percarbonate bleach results in a stronger tablet. Both two-layer tablets have the clay mineral all in one layer, and they are stronger than a comparable one-layer tablet which has no clay mineral, but have similar dissolution times.

What is claimed is:

1. A tablet of a compacted particulate composition for use in fabric washing, said tablet comprising:

(a) a base powder comprising 0.5 to 40% by weight-of an anionic surfactant and a detergency builder; and (b) post-dosed ingredients comprising (b1) a smectite clay mineral; and (b2) a material selected from the group consisting of materials with a water-solubility which exceeds 50 gm per 100 gm of water at 20° C., wherein the ratio of the clay mineral to the material with the water-solubility which exceeds 50 gm per 100 gm of water at 20° C is between 1:1 and 1:10.

2. A tablet according to claim 1 wherein the tablet contains from 15 to 60 wt % of water-insoluble detergency builder.

3. A tablet according to claim 1 wherein the smectite clay mineral is present in an amount between 0.5 wt % and 30 wt %.

4. A tablet according to claim 4 wherein the smectite clay mineral is present in an amount between 1 wt % and 15 wt %.

5. A tablet according to claim 1 wherein the amount of material which has a water-solubility which exceeds 50 grams per 100 grams of water at 20° C. is at least 7 wt % of the whole tablet.

6. A tablet according to claim 1 wherein the material with a water-solubility which exceeds 50 gm per 100 gm of water at 20° C. is selected from the group consisting of sodium citrate dihydrate, potassium carbonate, urea, sodium acetate in either its anhydrous, trihydrate or partially hydrated form, magnesium sulphate.$7H_2O$, potassium acetate, and mixtures thereof.

7. A tablet according to claim 6 wherein the material with a water-solubility which exceeds 50 gm per 100 gm of water at 20° C. is selected from the group consisting of sodium citrate dihydrate, sodium acetate in either its anhydrous, trihydrate or partially hydrated form, and mixtures thereof.

8. A tablet according to claim 1 wherein the smectite clay mineral is a fabric softening smectite clay with an ion exchange capacity of at least 70 meq/100 g of dry clay.

9. A tablet according to claim 8, wherein the smectite clay mineral is a montmorillonite.

10. A tablet according to claim 9, wherein the smectite clay mineral is provided by the presence of a bentonite clay.

11. A tablet according to claim 1 wherein the majority of the clay particles have a particle size between 0.35 mm and 0.71 mm.

12. A method of improving the disintegration of a tablet of compacted particulate composition for use in fabric washing, the method comprising forming a tablet according to claim 1.

13. A tablet of a compacted particulate composition for use in fabric washing, said tablet comprising:

(a) a base powder comprising 0.5 to 40% by weight of an anionic surfactant and a detergency builder; and (b) post-dosed ingredients comprising (b1) a smectite clay mineral; and (b2) a material selected from the group consisting of materials with a water-solubility which exceeds 50 gm per 100 gm of water at 20° C., wherein the ratio of the clay mineral to the material with the water solubility which exceeds 50 gm per 100 gm of water at 20° C. is between 1:1 and 1:10, and wherein the majority of the clay particles have a particle size between 0.35 mm and 0.71 mm.

14. A tablet of a compacted particulate composition for use in fabric washing, said tablet comprising:

(a) a base powder comprising 0.5 to 40% by weight of an anionic surfactant and a detergency builder; and (b) post-dosed ingredients comprising (b1) a smectite clay mineral; and (b2) a material selected from the group consisting of materials with a water-solubility which exceeds 50 gm per 100 gm of water at 20° C., wherein the ratio of the clay mineral to the material with the water solubility which exceeds 50 gm per 100 gm of water at 20° C. is between 1:1 and 1 :10, and wherein the particulate composition has bulk density of at least 700 g/liter.

* * * * *